US010304317B1

(12) United States Patent
Rajala

(10) Patent No.: US 10,304,317 B1
(45) Date of Patent: May 28, 2019

(54) METHOD AND SYSTEM FOR LOCATING A PERSONAL EMERGENCY RESPONSE SYSTEM (PERS) DEVICE BASED ON REAL ESTATE LOCKBOX INTERACTION

(71) Applicant: Numerex Corp., Atlanta, GA (US)

(72) Inventor: Yoganand Rajala, Alpharetta, GA (US)

(73) Assignee: Numerex Corp., Atlanta, GA (US)

( * ) Notice: Subject to any disclaimer, the term of this patent is extended or adjusted under 35 U.S.C. 154(b) by 0 days.

(21) Appl. No.: 14/991,028

(22) Filed: Jan. 8, 2016

(51) Int. Cl.
*G08B 25/01* (2006.01)
*G08B 25/10* (2006.01)

(52) U.S. Cl.
CPC ..... *G08B 25/016* (2013.01); *G08B 25/10* (2013.01)

(58) Field of Classification Search
CPC ..... G08B 25/016; G08B 25/10
See application file for complete search history.

(56) References Cited

U.S. PATENT DOCUMENTS 6,624,742 B1 * 9/2003 Romano ..... G06Q 50/16 340/12.5
9,704,315 B2 * 7/2017 Fisher ..... G07C 9/00174
2007/0245369 A1 * 10/2007 Thompson ..... G07C 9/00103 725/30
2008/0246587 A1 * 10/2008 Fisher ..... A47G 29/10 340/5.73
2009/0153291 A1 * 6/2009 Larson ..... E05B 19/0005 340/5.33
2009/0167488 A1 * 7/2009 Hays ..... G07C 9/00309 340/5.5
2009/0167526 A1 * 7/2009 Graves ..... G07C 9/00309 340/540
2012/0068817 A1 * 3/2012 Fisher ..... G07C 9/00571 340/5.61
2013/0187756 A1 * 7/2013 Fisher ..... G07C 9/00571 340/5.61
2014/0266586 A1 * 9/2014 Fisher ..... G08C 17/02 340/5.61

* cited by examiner

*Primary Examiner* — Patrick N Edouard
*Assistant Examiner* — Eboni N Hughes
(74) *Attorney, Agent, or Firm* — King & Spalding

(57) ABSTRACT

Real estate properties can have lockboxes that contain keys for gaining property access. The lockboxes can record information about each real estate agent who showed a property and can wirelessly transmit that information for storage in a database. The information can include the agent's identity, an identifier of the lockbox or property, and an access time, for example. The agent can carry a personal emergency response system (PERS) device so that the agent can send out a wireless emergency alert if the agent feels threatened or otherwise experiences an emergency situation. Upon receipt of such a wireless emergency alert, a remote system can access the database to determine one or more properties that the agent has visited. Thus, the system can track the agent and determine a location of the emergency situation.

22 Claims, 2 Drawing Sheets

METHOD AND SYSTEM FOR LOCATING A PERSONAL EMERGENCY RESPONSE SYSTEM (PERS) DEVICE BASED ON REAL ESTATE LOCKBOX INTERACTION

TECHNICAL FIELD

The present disclosure relates generally to personal emergency response system (PERS) devices, through which a user can raise an emergency alert, and more particularly to determining location of a user who as raised an emergency alert.

BACKGROUND

Personal emergency response system devices generally provide a capability through which a user can raise an emergency alert when the user feels threatened, becomes injured, or otherwise experiences an emergency situation. The emergency alert can be transmitted wirelessly to elicit a response from a remote recipient.

In some cases, the personal emergency response system device may utilize global positioning system (GPS) technology to transmit the user's location along with the emergency alert, so that the recipient can respond at the location. However in many situations, global positioning system technology may not be as reliable as desired or may have an undesirably high energy consumption that taxes battery life of a personal emergency response system device. Additionally, GPS technology often does not locate adequately indoors, as satellites are typically obscured from view inside buildings. With a conventional global positioning system approach, there may be situations where a user raises an emergency alert and the alert recipient is unable to determine the user's location with an ideal level of specificity or as quickly as desired. Other approaches may utilize cell tower-based or Wi-Fi-based location that are often less accurate than GPS and involve additional hardware and power consumption.

Accordingly, there are needs in the art for improved location tracking of a personal emergency response system device. For example, need exists for tracking location without necessarily relying on a global positioning system detector in the personal emergency response system device. Technology addressing such a need, or some related deficiency in the art, would support robust location tracking and/or personal emergency responses.

SUMMARY

In one aspect of the disclosure, a user of a personal emergency response system device can routinely interact with systems having known locations. When the user raises an emergency alert, a recipient of the emergency alert can locate or track the user based on one or more interactions the user has had with the systems of known locations. For example, if the user is a real estate agent who raises the emergency alert, the alert recipient can locate the agent by determining which real estate lockbox or lockboxes the agent has opened.

The foregoing discussion of wireless tracking and personal emergency response is for illustrative purposes only. Various aspects of the present disclosure may be more clearly understood and appreciated from a review of the following text and by reference to the associated drawings and the claims that follow. Other aspects, systems, methods, features, advantages, and objects of the present disclosure will become apparent to one with skill in the art upon examination of the following drawings and text. It is intended that all such aspects, systems, methods, features, advantages, and objects are to be included within this description and covered by this application and by the appended claims of the application.

Figure 1:
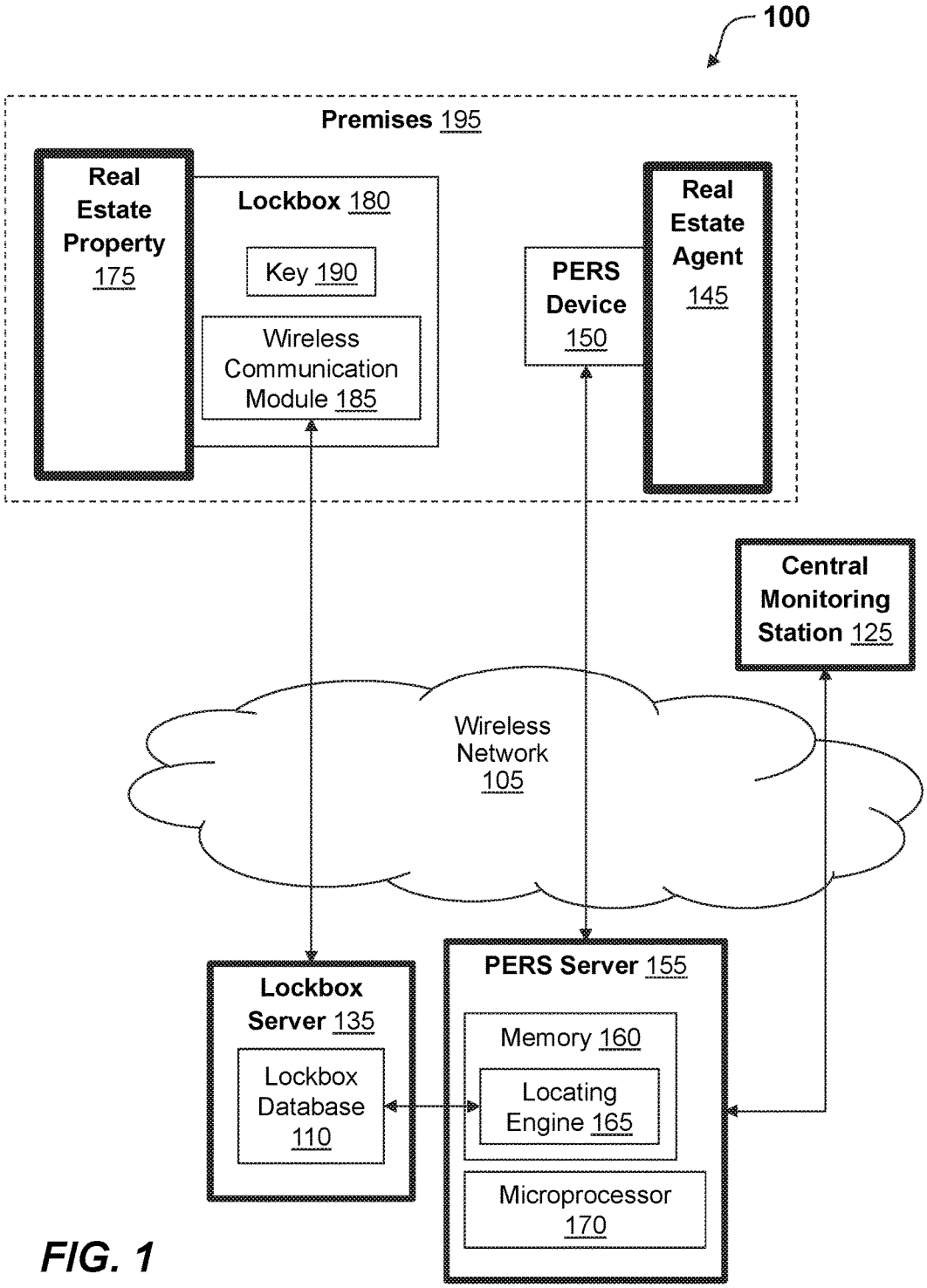
FIG. 1 is functional block diagram of a system for locating a personal emergency response system device in accordance with some example embodiments of the present disclosure.

Many aspects of the disclosure can be better understood with reference to the above drawings. The elements and features shown in the drawings are not necessarily to scale, emphasis being placed upon clearly illustrating the principles of exemplary embodiments of the present disclosure. Moreover, certain dimensions may be exaggerated to help visually convey such principles.

DESCRIPTION OF EXAMPLE EMBODIMENTS

Certain embodiments of the disclosure can improve operations of a computer-based system and process for tracking or determining location of a personal emergency response system device. Such improvements can comprise achieving more robust or accurate tracking, by providing operational redundancy via switching tracking modes when performance of one mode diminishes or encounters an operational obstacle, or by reducing energy consumption or extending battery life, for example.

Some example embodiments of the present disclosure will be discussed in further detail below with reference to the figures. However, the present technology can be embodied in many different forms and should not be construed as limited to the embodiments set forth herein. Rather, these embodiments are provided so that this disclosure will be thorough and complete, and will fully convey the scope of the disclosure to those having ordinary skill in the art. Furthermore, all "examples," "embodiments," "example embodiments," or "exemplary embodiments" given herein are intended to be non-limiting and among others supported by representations of the present technology.

Some of the embodiments may comprise or involve processes that will be discussed below. Certain steps in such processes may naturally need to precede others to achieve intended functionality or results. However, the technology is not limited to the order of the steps described to the extent that reordering or re-sequencing does not render the processes useless or nonsensical. Thus, it is recognized that some steps may be performed before or after other steps or in parallel with other steps without departing from the scope and spirit of this disclosure.

Turning now to FIG. 1, this figure illustrates a functional block diagram of an example system 100 for locating a personal emergency response system device 150 according to some embodiments of the present disclosure. The illustrated system 100 can be viewed as an example operating environment involving real estate. As will be further discussed below, user location can be determined, tracked, or approximated based on user interaction with one or more real estate lockboxes 180 of defined location.

The illustrated real estate application provides a non-limiting example of tracking user location based on user interactions with systems (in this example the real estate lockboxes 180) having known locations. When the user raises an emergency alert, a recipient of the emergency alert can locate or track the user (in this example a real estate agent 145) based on one or more interactions the user has had with the systems of known location. In the example illustrated in FIG. 1, the user interactions comprise opening (or otherwise interacting with) one or more lockboxes 180.

In the example system 100 illustrated in FIG. 1, the real estate agent 145 carries a personal emergency response system device 150. The real estate agent 145 can use the personal emergency response system device 150 to raise an emergency alert if the agent 145 experiences or encounters an emergency situation. For example, the personal emergency response system device 150 can transmit a wireless emergency alert if the real estate agent 145 feels threatened by a client, becomes injured, has an accident, observes a client heart attack, or otherwise perceives an emergency situation. In some embodiments, the personal emergency response system device 150 automatically senses an emergency condition (for example by detecting a lack of user motion or a heartbeat irregularity) or transmits the emergency alert based on user input (for example when the agent 145 pressing a button or otherwise makes an entry).

In some example embodiments, the personal emergency response system device 150 comprises a purpose built cellular communication device. To mention a few representative examples without limitation, the personal emergency response system device 150 can comprise a pendant, wristband, cardiac monitor, fall monitor, or pocket-carried device that has an emergency button.

In some embodiments, the personal emergency response system device 150 can comprise a generic cellular telephone, such as a multipurpose smartphone. In such an embodiment, a personal emergency response application can be loaded onto the generic cellular telephone to support personal emergency response functionality. The personal emergency response application can display an icon or button on a graphical user interface that the real estate agent 145 can touch or otherwise engage to raise an emergency alert, for example.

In some embodiments, the personal emergency response system device 150 comprises a global positioning system (GPS) sensor for locating the device 150. In such an embodiment, the personal emergency response system device 150 can be located without utilizing the global positioning system sensor, for example when the sensor is unavailable (thus providing redundancy) or to extend battery life of the personal emergency response system device 150. In some embodiments, the personal emergency response system device 150 can comprise a location technology such as GPSOne or Wi-Fi to utilize when GPS is unavailable, for example.

In some other embodiments, the personal emergency response system device 150 can comprise capabilities for location using technologies based on tower identification, cellular-based location, cell tower triangulation, advanced forward link trilateration (AFLT), Wi-Fi, or other appropriate approach. In such cases, lockbox information can be used to improve accuracy if alternative technologies are unable to produce accurate location due to environmental conditions.

In the illustrated example of FIG. 1, the real estate agent 145 routinely shows real estate properties 175 to prospective buyers or renters. Each real estate property 175 has an associated lockbox 180 that holds a key 190 for providing access to a building, gate, or other secured enclosure. In an example embodiment, the lockbox 180 is on the premises 195 of the real estate property 175. The lockbox 180 can be attached to a handle of a door or a gate on the premises 195, for example.

In some embodiments, the real estate agent 145 gains access to the lockbox 180 by entering a code (such as a personal identification number (PIN)) that is specific to the real estate agent 145). In some embodiments, the real estate agent 145 gains access to the lockbox 180 using a physical key. In some embodiments, the real estate agent 145 gains access to the lockbox 180 using a handheld security hardware device that comprises a build-in authentication for secure access, for example using a "fob." Such a fob can emit a short-range wireless signal that identifies the real estate agent 145 to the lockbox 180 and enables access to the key 190, and thus to the property 175. In some other embodiments, an application installed on an agent's cell phone communicates to the lockbox 180 using a short-range communication such as Bluetooth low energy (BLE), for example.

When the real estate agent 145 accesses or otherwise interacts with the lockbox 180, the lockbox 180 transmits a long-range wireless signal via a wireless communication module 185. The long-range wireless signal can identify the real estate agent 145, a time of the interaction, a location of the premises 195, the lockbox 180, or provide other information that can be useful in an emergency situation.

In some embodiments, the lockbox 180 may utilize alternative communication rather than a long-range wireless communication module. For example, the lockbox 180 can comprise a short-range wireless communication module such as Bluetooth or Bluetooth low energy. When the real estate agent 145 operates the lockbox 180 with his or her mobile phone using Bluetooth, the agent's mobile phone can communicate with the lockbox server 135 or the personal emergency response system server 155 to transmit and provide lockbox and agent information.

In some embodiments, the lockbox 180 records (and/or transmits) when the real estate agent 145 comes within a certain distance of the lockbox 180. For example, the lockbox 180 may determine that the real estate agent 145 is in the vicinity of the lockbox 180 based on receipt of a short-range signal emitted from the personal emergency response system device 150. Such a short-range signal can identify the personal emergency response system device 150 and/or the real estate agent, for example.

In some embodiments, the lockbox 180 can locally store information about interactions and transmit an interaction log when prompted by a remote signal, for example. In some embodiments, the lockbox 180 can locally store information about interactions and transmit an interaction log at the end of each day or on another appropriate time cycle. In some embodiments, the lockbox 180 can transmit information at each user interaction. In some embodiments, the lockbox 180 can transmit information when opened for key removal, when closed for key return, and/or on key removal and on key return.

In the illustrated embodiment, the system 100 comprises a wireless network 105. The wireless network 100 can comprise a cellular system that uses cellular towers to support long-range communication, for example. In some embodiments, the wireless network 105 comprises one or more cellular systems networked with a packet-switched network such as the Internet or a private network.

As illustrated, the lockbox 180 communicates with a lockbox server 135 over the wireless network 105, and the personal emergency response system device 150 also communicates with a personal emergency response system server 155 over the wireless network 105. In some embodiments, the lockbox server 135 and the personal emergency response system device 150 communicate over different wireless networks 105.

As illustrated, the lockbox server 135 comprises a lockbox database 110 for storing information received from the lockbox 180 via the wireless communication module 185 and/or information about the various lockboxes 180 and associated property locations, for example. Information may alternatively or further be obtained through the agent's mobile phone as discussed above, for example.

As illustrated, the personal emergency response system device server 155 can respond to communications received from the personal emergency response system device 150, including emergency alerts, for example. The personal emergency response system device server 155 can comprise a gateway or middleware server. The personal emergency system device server 155 can comprise communication interfaces for communication with the lockbox database 110, the personal emergency response system device 150, and the central monitoring station 125.

In the illustrated embodiment, the system 100 comprises a central monitoring station 125. The personal emergency response system server 155 can communicate with the central monitoring station 125 over the wireless network 105. In an example embodiment, the central monitoring station 125 can comprise agents for responding when the real estate agent 145 raises an alarm. For example, when the personal emergency response system server 155 receives an emergency alert, the server 155 can forward the alert to the central monitoring station 125 to respond or take appropriate action. A human agent at the central monitoring station 125 may open a two-way voice channel to the personal emergency response system device 150 and make a decision about calling and deploying police, ambulance, or other emergency personnel, for example.

In an example embodiment, the personal emergency response system server 155 provides location services for the personal emergency response system device 150 as well as for other wireless tracking devices (not illustrated) that may be attached to people, animals, or objects. In some embodiments, the personal emergency response system device server 155 may store configuration data that may be downloaded to personal emergency response system devices 150, such as during startup or rebooting, and/or application programs downloaded to generic cellular telephones as discussed above.

In some example embodiments, the personal emergency response system server 155 can comprise a group or cluster of servers acting as a single logical entity. In some embodiments, the personal emergency response system server 155 comprises the lockbox server 135. In some embodiments, the personal emergency response system server 155 and the lockbox server 135 are collocated but are separate devices that may be networked or linked together. The personal emergency response system server 155 and the lockbox server 135 can be remote from one another in some embodiments, and may be managed by different business entities. In various embodiments, the personal emergency response system server 155 and the lockbox server 135 can be disposed in a common enclosure or equipment cabinet, in a common rack, or on a common card in a rack, for example.

In the illustrated example form, the personal emergency response system server 155 comprises a microprocessor 170, memory 160, and a locating engine 165 stored in the memory 160 and executed by the microprocessor 170.

Example embodiments of the memory 160 can comprise volatile and nonvolatile memory, such as random access memory (RAM) and flash memory for example. In an example embodiment, the memory 160 can comprise firmware for executing management and control functions. For example, the memory 160 can comprise persistent memory that stores program code, including the locating engine 165. An example embodiment of the locating engine 165 can comprise computer executable instructions for implementing process 200 that is illustrated in flowchart form in FIG. 2 and discussed below.

In some example embodiments, the locating engine 165 can switch between two locating modes when conditions warrant. In one mode, the locating engine 165 can utilize GPS technology for locating the personal emergency response system device 150. In another mode, the locating engine 165 can locate or track the personal emergency response system device 150 utilizing lockbox interactions as further discussed below.

In some example embodiments, location determination via GPS is the default mode of location. In some example embodiments, location determination using lockbox interaction is the default mode of location operation. Such an embodiment can be utilized to conserve or extend battery life of the personal emergency response system device 150, for example.

In some example embodiments, location tracking switches from GPS to lockbox interaction when GPS is unavailable or is subject to diminished performance. For example, the locating engine 165 can switch away from GPS when a GPS signal is unavailable or is noisy. In some embodiments, the locating engine 165 utilizes GPS location and lockbox interactions concurrently, for example to verify or double check location.

Figure 2:
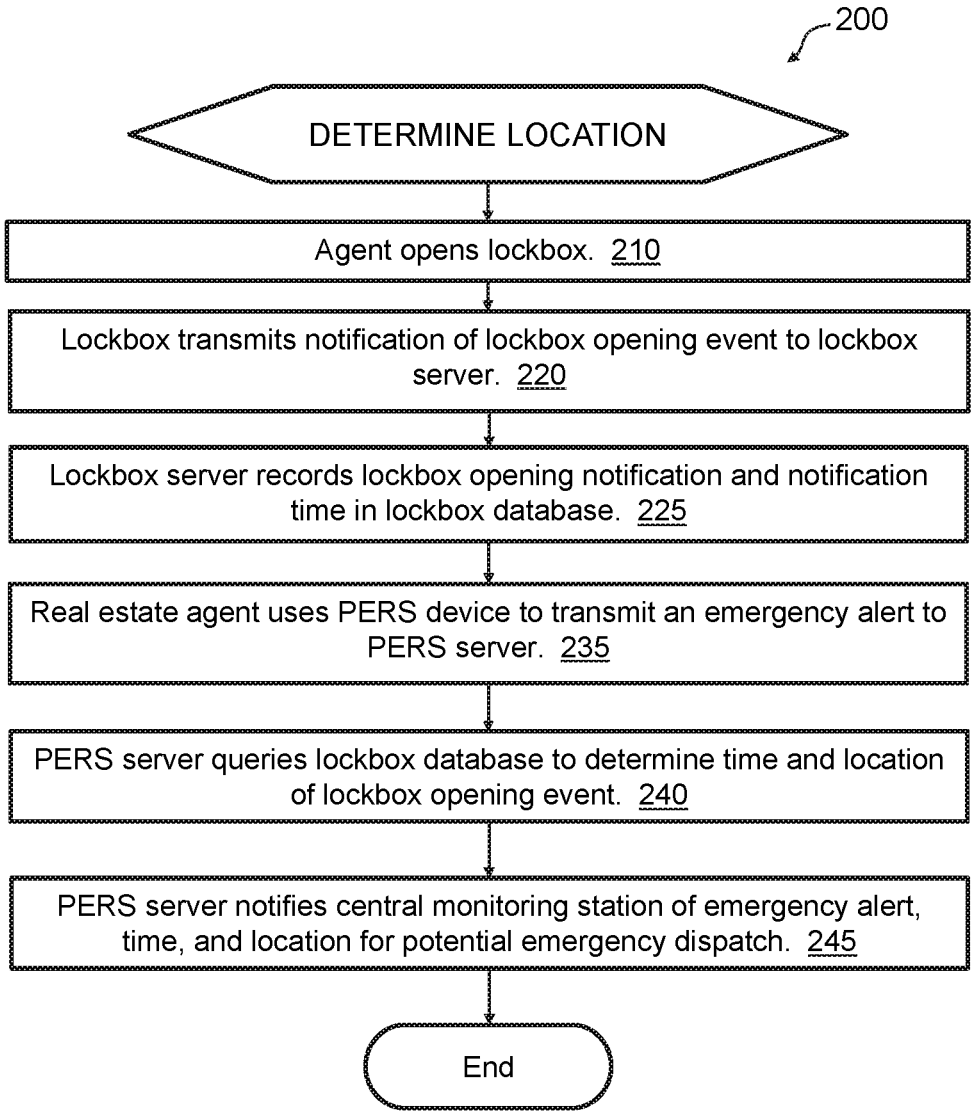
FIG. 2 is flowchart of a process for locating a personal emergency response system device in accordance with some example embodiments of the present disclosure.

Turning now to FIG. 2, this figure illustrates a flowchart of an example process 200 for locating the personal emergency response system device 150 according to some embodiments of the present disclosure. Process 200 can comprise an example embodiment of the locating engine 165, for example.

In some example embodiments, instructions for execution of the relevant steps of process 200 can be stored in the memory 160 and executed by the microprocessor 170 of the personal emergency response system server 155. For example, process 200 can be practiced using instructions that are provided in the locating engine 165 or in some other appropriate location or locations. Recognizing that the process 200 can be implemented or practiced in various places, the process 200 will be discussed below with reference to an embodiment in which instructions are stored in the personal emergency response system server 155, without limitation. As discussed above, the personal emergency response system server 155 can comprise a gateway or middleware server.

At block 210 of process 200, the real estate agent 145 opens the lockbox 180. As discussed above, the real estate agent 145 may alternatively interact with the lockbox 180 by coming close enough to support short-range communication or moving onto the premises 195.

At block 220 of process 200, the lockbox 180 wirelessly transmits notification of the lockbox opening event or agent interaction that occurred at block 210. The transmission may be addressed to the lockbox server 135 or otherwise intended for receipt at the lockbox server 135, for example. The transmission can include an identification of the real estate agent 145 who opened the lockbox 180. In some embodiments, the real estate agent 145 opens the lockbox 180 utilizing a cell phone, and an application on the cell phone notifies the lockbox server 135 with appropriate data.

At block 225, the lockbox server 135 receives the notification and records information conveyed in the notification. For example, the lockbox server 135 can store one or more of the time of the notification, an identification of the lockbox 180 (for example a unique, lockbox-specific code), an identification of the real estate property 175 (for example a unique, property-specific code), and an identification of the real estate agent 145 (for example a unique, agent-specific code). The information can be stored in the lockbox database 110, for example.

At block 235, the real estate agent 145 uses the personal emergency response system device 150 to raise an emergency alert. The agent 145 can depress a physical button or touch an icon on a graphical user interface as discussed above, for example. In response to this entry, the personal emergency response system device 150 can transmit a wireless emergency alert for receipt at the personal emergency response system server 155, for example.

At block 240, the personal emergency response system server 155 receives the alert and queries the lockbox database 110 for information related to the alert. The lockbox database 110 can return a time and a location of the most recent lockbox interaction of the real estate agent 145, for example. In an example embodiment, the personal emergency response system server 155 sends an agent's identification to the lockbox database 110, and the database 110 returns information about that agent's most recent lockbox opening. The information can include time and coordinates or street address of that agent's most recent lockbox opening, for example. In some embodiments, the lockbox database 100 stores lockbox identifications and associated physical coordinates or addresses.

At block 245, the personal emergency response system server 155 notifies the central monitoring station 125 about the emergency alert. The sever 155 can provide the central monitoring station 125 with a time and a location of the emergency alert as well as an identification of the real estate agent 145, for example. The central monitoring station 125 can dispatch emergency assistance or take other appropriate action as discussed above.

In various embodiments, the personal emergency response system server 155 can directly notify emergency situation handling personnel, a public-safety access point (PSAP), or corporate security personnel about the emergency alert. In some embodiments, the personal emergency response server 155 can notify registered family members, a registered supervisor, or a security authority of a member's organization.

Following block 245, process 200 ends. In some example embodiments, process 200 iterates repetitively, in whole or part, to identify emergency situations, track agents, and take action as deemed appropriate.

Technology for location determination that is useful in real estate and other environments and applications has been described. From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the exemplary embodiments, equivalents of the elements shown therein will suggest themselves to those skilled in the art, and ways of constructing other embodiments of the present technology will appear to practitioners of the art.

What is claimed is:

1. A system comprising:

a personal emergency response system (PERS) server, the PERS server comprising:

a communication interface configured to receive an emergency alert transmitted wirelessly from a PERS device that comprises a global positioning system (GPS) sensor and that is associated with a real estate agent;

memory;

a processor that is operably coupled to the communication interface and to the memory; and processor executable instructions stored in the memory for performing the steps of:

if a GPS signal from the GPS sensor is available, then responsive to receiving the emergency alert from the PERS device, locating the real estate agent based on the GPS signal that is included in the emergency alert, the GPS signal comprising location data of the PERS device;

if the GPS signal from the GPS sensor is unavailable, then responsive to receiving the emergency alert from the PERS device, querying a database of a lockbox server to determine a location of a lockbox accessed by the real estate agent at a time using an identifier of the real estate agent that is included in the emergency alert, the lockbox server being remote from the PERS server, and the location data of the PERS device being absent from the emergency alert when the GPS signal is unavailable;

wherein the database of the lockbox server receives a long-range wireless signal from a wireless communication module of the lockbox in response to an access of the lockbox by the real estate agent, the long-range wireless signal comprising information associated with the access of the lockbox by the real estate agent, wherein the information identifies the real estate agent, a lockbox access time, and a location of the lockbox, and wherein the database records the information associated with the access of the lockbox; and transmitting a message about the emergency alert to a remote recipient, the message identifying the determined location of the lockbox and the time.

2. The system of claim 1, wherein transmitting the message comprises notifying emergency situation handling personnel about the determined location and the time, and wherein querying the database to determine the location of the lockbox accessed by the real estate agent at the time comprises identifying the lockbox that the real estate agent visited prior to origination of the emergency alert.

3. The system of claim 1, wherein the remote recipient comprises a public-safety access point (PSAP).

4. The system of claim 1, wherein transmitting the message comprises notifying corporate security personnel about the determined location and the time.

5. The system of claim 1:

wherein the message is operative to prompt an emergency response to the determined location, and wherein the remote recipient comprises a central monitoring station.

6. The system of claim 1, wherein the PERS device comprises a purpose-build PERS device or a generic cellular telephone loaded with a PERS application.

7. The system of claim 1, wherein the processor executable instructions stored in the memory are further for locating the real estate agent by determining a plurality of real estate lockboxes the real estate agent has accessed, the plurality of real estate lockboxes comprising said real estate lockbox.

8. The system of claim 1, wherein transmitting the message comprises notifying friends and family members.

9. A server associated with a personal emergency response system (PERS) device comprising:

a first communication interface configured to receive an emergency alert transmitted wirelessly from the PERS device that comprises a global positioning system (GPS) sensor and that is associated with a real estate agent;

a second communication interface configured to communicate with a lockbox database of a lockbox server, wherein the lockbox database of the lockbox server receives a long-range wireless signal from a wireless communication module of a lockbox in response to an access of the lockbox by the real estate agent, the long-range wireless signal comprising information associated with the access of the lockbox by the real estate agent, wherein the information identifies the real estate agent, a lockbox access time, and a location of the lockbox, and wherein the database records the information associated with the access of the lockbox;

a third communication interface configured to communicate with a central monitoring station;

memory;

a processor that is operably coupled to the first, second, and third communication interfaces and to the memory; and processor executable instructions stored in the memory for performing a process that comprises the steps of:

in response to receiving the emergency alert via the first communication interface:

if a GPS signal from the GPS sensor is available at the server, then locating the real estate agent based on the GPS signal that is included in the emergency alert from the PERS device, the GPS signal comprising location data of the PERS device; and if the GPS signal from the GPS sensor is unavailable at the server, then determining the location of the lockbox accessed by the real estate agent based on the information that is stored in the lockbox database and that is obtained via the second interface, wherein determining the location of the lockbox comprising querying the lockbox database using an identifier of the real estate agent that is included in the emergency alert, wherein the location data of the PERS device is absent from the emergency alert when the GPS signal from the GPS server is unavailable; and sending a notification about the emergency alert to the central monitoring station via the third communication interface.

10. The server of claim 9, wherein the step of sending the notification comprises informing the central monitoring station about the determined location of the lockbox, and wherein the server comprises a middleware server.

11. The server of claim 9, wherein the step of sending the notification comprises informing the central monitoring station about the time that the real estate agent accessed the lockbox and about the determined location.

12. The server of claim 9, wherein the server comprises a PERS server.

13. The server of claim 9, wherein the PERS device comprises a purpose-build PERS device.

14. The server of claim 9, wherein the PERS device comprises a generic cellular telephone loaded with a PERS application.

15. A method comprising the steps of:

receiving, by a personal emergency response system (PERS) server, an emergency alert originating from a PERS device associated with a real estate agent;

identifying, by the PERS server, a lockbox that the real estate agent visited prior to origination of the emergency alert;

in the absence of location data of the PERS device in the emergency alert received from the PERS device due to unavailability of a GPS signal at the PERS device, determining, by the server, a location of the lockbox by communicating with a lockbox server that is remote from the PERS server and referencing a database of the lockbox server that associates lockbox identity with lockbox location, wherein the database of the lockbox server receives a long-range wireless signal from a wireless communication module of the lockbox in response to an access of the lockbox by the real estate agent, the long-range wireless signal comprising information associated with the access of the lockbox by the real estate agent, wherein the information identifies the real estate agent, the lockbox identity, a lockbox access time, and the lockbox location, and wherein the database records the information associated with the access of the lockbox; and notifying, by the PERS server, a remote recipient about the emergency alert and about the location.

16. The method of claim 15, wherein the remote recipient comprises a public-safety access point (PSAP).

17. The method of claim 15, wherein notifying the remote recipient comprises notifying corporate security personnel.

18. The method of claim 15, wherein the notifying step comprises prompting an emergency response to the determined location.

19. The method of claim 15, wherein the PERS device comprises a purpose-build PERS device.

20. The method of claim 15, wherein the PERS device comprises a generic cellular telephone loaded with a PERS application.

21. The method of claim 15, wherein a record reflects that the real estate agent has visited a series of lockboxes, and wherein the step of identifying the lockbox that the real estate agent visited prior to origination of the emergency alert comprises identifying the most recent lockbox in the series.

22. The method of claim 15, wherein notifying the remote recipient comprises notifying corporate friends and family.

* * * * *